US006693067B2

(12) United States Patent
Kim

(10) Patent No.: US 6,693,067 B2
(45) Date of Patent: Feb. 17, 2004

(54) WATER-SOLUBLE COMPOSITION FOR REMOVING RUST FROM STEEL BAR AND STEEL FRAME

(75) Inventor: Kwon-Taeg Kim, Buchun-shi (KR)

(73) Assignees: Chum Dan Technical Evolution, Seoul (KR); Sang Keun Oh, Seoul (KR)

( * ) Notice: Subject to any disclaimer, the term of this patent is extended or adjusted under 35 U.S.C. 154(b) by 0 days.

(21) Appl. No.: 10/247,072

(22) Filed: Sep. 18, 2002

(65) Prior Publication Data

US 2003/0114328 A1 Jun. 19, 2003

(30) Foreign Application Priority Data

Sep. 22, 2001 (KR) ..... 2001-59448

(51) Int. Cl.[7] ..... G11D 17/00

(52) U.S. Cl. ..... 510/245; 510/202; 510/203; 510/254; 510/255; 510/258; 510/422; 510/427; 510/510; 510/507; 134/2; 134/3; 134/41

(58) Field of Search ..... 510/202, 203, 510/245, 255, 258, 422, 427, 510, 507; 134/2, 3, 41

(56) References Cited

U.S. PATENT DOCUMENTS 6,106,774 A * 8/2000 Monticello et al. ..... 422/28
6,221,823 B1 * 4/2001 Crisanti et al. ..... 510/238
6,521,578 B1 * 2/2003 Stute et al. ..... 510/238

* cited by examiner

*Primary Examiner*—Necholus Ogden
(74) *Attorney, Agent, or Firm*—Bell, Boyd & Lloyd LLC

(57) ABSTRACT

The present invention relates to a water-soluble composition for removing rust from steel bars and steel frames, which is environmentally harmless and permits improving work efficiency by allowing work to be conducted in a state where rust was simply removed from the steel bars and frames by applying it on the steel bars or frames with a spray or brush. The rust-removing preparation of the present invention comprises a mixture of 10–11% by weight of phosphoric acid, 6–7% by weight of sodium pyrophosphate, 6–7% by weight of a hard water softener, 7–8% by weight of zeolite, 2–3% by weight of xanthan, 2–3% by weight of a surfactant, 4–5% by weight of stearic acid, 6–7% by weight of methyl alcohol and 2–3% by weight of a defoamer in 50–51% by weight of water.

2 Claims, No Drawings

WATER-SOLUBLE COMPOSITION FOR REMOVING RUST FROM STEEL BAR AND STEEL FRAME

BACKGROUND OF THE INVENTION

1. Field of the Invention

The present invention relates to a water-soluble composition for removing rust from steel bars and steel frames. More particularly, the present invention relates to a water-soluble composition for removing rust from steel bars and steel frames, which is environmentally harmless and permits improving work efficiency by allowing work to be conducted in a state where rust was simply removed from the steel bars and frames by applying it on the steel bars or frames with a spray or a brush, when the steel bars and frames gather rust at their surface due to delay of construction work or long-term leaving of the steel bars and frame in the open air such that work such as concrete casting can not be carried out.

2. Background of the Related Art

Generally, metals gather rust by the action of oxygen, moisture and carbon dioxide, etc. in air. This not only accelerates corrosion of metals but also attributes to weakening of adhesion of concrete to the steel bars and frames which are particularly used as a frame of buildings in the construction field. For this reason, after rust produced on the surface of the steel bars and frame is removed, concrete work is conducted. In removing rust, rust is conventionally removed directly by a person with an iron brush, or it is removed by applying a hydrochloric acid-based solution on the metal surface.

However, since this hydrochloric acid-based preparation for removing rust contains volatile components, it is difficult for the preparation to be formulated. Also, upon opening of a container containing the preparation, irritative gas harmful to the human body is emitted to make the work difficult. Furthermore, it is environmentally harmful, and particularly, when it is stained on the human body, it can cause a burn so as to give a fatal injury to the human body. Thus, it is disadvantageous in that it is problematic in terms of safety and environmentally harmful.

SUMMARY OF THE INVENTION

Accordingly, the present invention is directed to a water-soluble composition for removing rust from steel bars and steel frames, that substantially obviates one or more problems due to limitations and disadvantages of the related art.

An object of the present invention is to provide a composition for removing rust from steel bars and steel frames, which is prepared by mixing and ionically bonding various materials, including non-volatile, colorless, odorless and adsorptive phosphoric acid, zeolite, a surfactant, a specific softener and inactive components, in pure water, and which permits easily removing rust such as oxides produced on metal surfaces, and additionally forms a coating film on the metal surfaces to give a rust proofing effect, and also is soluble in water and thus harmless to the human body.

To achieve this object, the present invention provides a water-soluble composition for removing rust from steel bars and steel frames, which comprises a mixture of 10–11% by weight of phosphoric acid, 6–7% by weight of sodium pyrophosphate, 6–7% by weight of a hard water softener, 7–8% by weight of zeolite, 2–3% by weight of xanthan gum, 2–3% by weight of a surfactant, 4–5% by weight of stearic acid, 6–7% by weight of methyl alcohol and 2–3% by weight of a defoamer in 50–51% by weight of water.

DETAILED DESCRIPTION OF THE PREFERRED EMBODIMENT

According to the present invention, there is provided a composition for removing rust from steel bars and steel frames, which comprises a mixture of 10–11% by weight of phosphoric acid, 6–7% by weight of sodium pyrophosphate, 6–7% by weight of a hard water softener, 7–8% by weight of zeolite, 2–3% by weight of xanthan gum, 2–3% by weight of a surfactant, 4–5% by weight of stearic acid, 6–7% by weight of methyl alcohol and 2–3% by weight of a defoamer in 50–51% by weight of water Hereinafter, the respective components used in the water-soluble composition for removing rust from the steel bars and frames according to the present invention will be specifically described.

Phosphoric acid used in the composition of the present invention has a melting point of 42.35° C. and a specific gravity of 1.834 and is colorless, odorless and highly viscous. With an increased concentration, it is liable to be crystallized and shows strong deliquescence. In addition, it is non-volatile and used as a metal surface-treating agent.

The sodium pyrophosphate is a white powder of a molecular weight of 265.90 and alkaline in an aqueous solution. Also, it forms a complex with $Fe^{3+}$ and $Mg^{2+}$, and has a metal ion-blocking force.

The hard water softener is ultra-phosphates and amorphous. Also, it has a strong power to complex polymeric ions, and has an excellent ability to prevent dispersion and precipitation so that it shows a strong pH buffer action in the acidic region.

The zeolite has a specific gravity of 2.2 and is a mineral that is aluminum silicate hydrate of alkali and alkaline earth metals. Also, it is colorless and transparent, well soluble in acidic materials and used as an ion exchange agent, an adsorbent and a catalytic agent.

The xanthan gum is used as a thickener, a coating agent and a raw material of plastics, and is physically and chemically highly stable. Also, it is decomposed by microorganisms so that it has no effect on environment.

The surfactant shows very excellent dispersing and emulsifying actions in an aqueous solution so that it allows two materials to be effectively linked. Also, it has an effect of reducing surface tension and thus makes penetration of fine parts easy.

The stearic acid is a white glossy solid and shows a melting point of 60–70° C. and a boiling point of 219° C. upon heating.

After thick rust is removed with a steel brush or a wire grinder and oily substances or coatings are removed with other devices, the rust-removing composition of the present invention as described above is applied on the surface of metals with a spray or a brush to remove rust.

After removing rust with the rust-removing composition, the metal surface can be whitened due to moisture, water or rain, but it has no effect on the subsequent process.

The present invention will hereinafter be described in further detail by examples. It should however be borne in mind that the present invention is not limited to or by the test examples.

EXAMPLE 1

A composition was prepared by mixing 10% by weight of phosphoric acid, 7% by weight of sodium pyrophosphate, 6.5% by weight of a hard water softener, 8% by weight of zeolite, 2% by weight of zanthan gum, 2.5% by weight of surfactant, 5% by weight of stearic acid, 6.5% by weight of methyl alcohol and 2.5% by weight of a defoamer in 50% by weight of water. A test specimen was manufactured by coating steel bars with the composition and tested for compression strength and adhesion strength of concrete. The test results are indicated in Tables 1 below.

TABLE 1

Compression Strength and Concrete Strength (28 days after treated)

| | Compression strength ($kgf/cm^2$) | Maximum tensile load (kgf) | Adhesion strength of concrete (kgf) | Strength ratio (%) |
|---|---|---|---|---|
| Raw steel bar | 362 | 16397 | 79.12 | 100 |
| Rusty steel bar | | 16480 | 79.52 | 100.51 |
| Steel bar treated with the composition of the invention | | 16684 | 80.51 | 101.75 |
| Steel bar whitened after treatment with the composition of the invention | | 16802 | 81.07 | 102.47 |

Formulation of concrete used the above example is as a table below.

| W/C (%) | S/A (%) | SLUMP (cm) | W | C | S | G | AD |
|---|---|---|---|---|---|---|---|
| 39.8 | 41.9 | 12.8 | 165 | 414 | 730 | 1037 | CX 0.04% |

It was found that the adhesion strengths of the steel bar treated with the composition of the present invention and the steel bar whitened after treatment with the composition of the invention were 1–3% higher than the raw steel bar. This is because an insoluble phosphate coating formed by the following reactions (1)–(3) between the phosphate-based preparation of the present invention and the steel bar serves as a primer so as to increase the adhesion strength of concrete to the steel bar.

Reaction (1):

$$Fe(H_2PO_4)_2 \leftrightarrows Fe(HPO)_4 + H_3PO_4$$

Reaction (2):

$$3Fe(HPO_4) \leftrightarrows Fe_3(HPO_4)_2\downarrow + H_3PO_4$$

Reaction (3):

$$Fe + 2H_3PO_4 \leftrightarrows Fe(H_2PO_4)_2 + H_2\uparrow$$

Namely, on the steel surface applied with the composition, phosphoric acid ($H_3PO_4$) is consumed according to the reaction (3). For replenishment of this phosphoric acid, the reactions (2) and (3) are progressed toward the right side, so that phosphates of $Fe(HPO)_4$ and $Fe_3(HPO_4)_2$ are adhered on the steel surface to form a phosphate coating serving as a primer. Thus, after removal of oxides, the adhesion strength of the steel bar is increased.

Meanwhile, although the result of 1–3% increases in adhesion strength of concrete after removal of oxide could not be regarded as a remarkable change of physical properties according to treatment with the rust-removing composition, it is believed that there was no reduction in adhesion strength after removal of rust.

Also, although the whitened steel bar showed a 1% increase in adhesion strength as compared to the steel bar treated with the rust-removing composition, it is believed that this 1% difference in adhesion strength was insignificant and the white foreign substances had little or no effect on a reduction in adhesion strength.

Harmfulness Test to Curing of Cement

A test specimen treated with the rust-removing composition of the present invention at its surface, and a control specimen not treated with the rust-removing composition, were tested for harmfulness to curing reaction of cement. The test results are indicated in Table 2 below.

TABLE 2

Results of Test of Harmfulness to Curing Reaction of Cement

| Test specimen | Flexural breaking load (kgf) | Flexural Strength ($kgf/cm^2$) |
|---|---|---|
| Surface-treated with the rust-removing composition of the present invention | 498 | 117 |
| Not treated with the rust-removing composition of the present invention | 491 | 115 |

From the results indicated in Table 2, it could be found that there was no flexural strength difference between the specimen applied with the rust-removing composition at its surface and the specimen not applied with the rust-removing composition. This suggests that the use of the rust-removing preparation exhibits no adhesion strength difference of concrete from the raw steel bar.

Harmfulness Test to Human Body

The rust-removing composition of the present invention was tested for contents of harmful heavy metals according to an Inductively Coupled Plasma (ICP) method. Results are indicated in Table 3.

TABLE 3

Results of Test of Harmful Heavy Metal Contents

| Heavy metal atom | Unit | Test result | Test method |
|---|---|---|---|
| As | ppm | Not detected | ICP |
| Cd | ppm | Not detected | ICP |
| Hg | Ppm | Not detected | ICP |
| Pb | ppm | Not detected | ICP |

From the results indicated in Table 3 above, it was found that the rust-removing composition of present invention contains no heavy metal atoms harmful to the human body, such as As, Cd, Hg and Pb.

As described above, according to the present invention, rust as oxides produced on the surface of the steel bars, can be simply removed with the rust-removing composition, which contains no heavy metals harmful to the human body and is not based on the hydrochloric acid. Thus, work can be conducted at increased adhesion of concrete to the steel bars, so that work efficiency is improved. Also, the rust-removing composition is environment-friendly. Particularly, in the construction field, rust can be removed by spraying the rust-removing composition without separation of a mold from a steel-bar arrangement.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A water-soluble composition for removing rust from steel bars and steel frames, comprising a mixture of approximately 10 to about 11% by weight of phosphoric acid, approximately 6 to about 7% by weight of sodium pyrophosphate, approximately 6 to about 7% by weight of a hard water softener, approximately 7 to about 8% by weight of zeolite, approximately 2 to about 3% by weight of xanthan gum, approximately 2 to about 3% by weight of a surfactant, approximately 4 to about 5% by weight of stearic acid, approximately 6 to about 7% by weight of methyl alcohol and approximately 2 to about 3% by weight of a defoamer in approximately 50 to about 51% by weight of water.

2. A method for removing rust from steel bars and steel frames, comprising the step of contacting a steel bar or steel frame with a mixture of approximately 10 to about 11% by weight of phosphoric acid, approximately 6 to about 7% by weight of sodium pyrophosphate, approximately 6 to about 7% by weight of a hard water softener, approximately 7 to about 8% by weight of zeolite, approximately 2 to about 3% by weight of xanthan gum, approximately 2 to about 3% by weight of a surfactant, approximately 4 to about 5% by weight of stearic acid, approximately 6 to about 7% by weight of methyl alcohol and approximately 2 to about 3% by weight of a defoamer in approximately 50 to about 51% by weight of water.

* * * * *